US011076732B2

(12) United States Patent
Yang et al.

(10) Patent No.: US 11,076,732 B2
(45) Date of Patent: Aug. 3, 2021

(54) VACUUM CLEANER

(71) Applicant: Samsung Electronics Co., Ltd, Suwon-si (KR)

(72) Inventors: Dong Houn Yang, Suwon-si (KR); Hyeon Cheol Kim, Hwaseong-si (KR); Joung Soo Park, Suwon-si (KR); Do Kyung Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 345 days.

(21) Appl. No.: 16/097,118

(22) PCT Filed: Apr. 17, 2017

(86) PCT No.: PCT/KR2017/004098

§ 371 (c)(1),
(2) Date: Oct. 26, 2018

(87) PCT Pub. No.: WO2017/188638

PCT Pub. Date: Nov. 2, 2017

(65) Prior Publication Data

US 2019/0104901 A1 Apr. 11, 2019

(30) Foreign Application Priority Data

Apr. 28, 2016 (KR) ..... 10-2016-0052231

(51) Int. Cl.
*A47L 9/06* (2006.01)
*A47L 9/00* (2006.01)

(52) U.S. Cl.
CPC ..... *A47L 9/0653* (2013.01); *A47L 9/00* (2013.01); *A47L 9/0072* (2013.01); *A47L 9/06* (2013.01); *A47L 9/066* (2013.01)

(58) Field of Classification Search
CPC . A47L 9/0653; A47L 9/00; A47L 9/06; A47L 9/0072; A47L 9/066
(Continued)

(56) References Cited

U.S. PATENT DOCUMENTS 5,539,953 A 7/1996 Kurz
7,552,507 B2 * 6/2009 Burnham ..... A47L 9/04 15/416

(Continued)

FOREIGN PATENT DOCUMENTS

EP 2098150 A2 9/2009
EP 2875765 A1 5/2015

(Continued)

OTHER PUBLICATIONS

International Search Report dated Jul. 27, 2017 in connection with International Patent Application No. PCT/KR2017/004098.

(Continued)

*Primary Examiner* — David Redding

(57) ABSTRACT

Disclosed is a vacuum cleaner that opens or closes a hole formed in a suction portion according to a state of a surface to be cleaned, thereby efficiently cleaning. A vacuum cleaner includes a suction portion configured to suck foreign materials on a surface to be cleaned. The suction portion includes a case having an air hole formed in a flow path, a frame configured to be accommodated in the case and open or close the air hole, and a button configured to be mounted on the case and be operated to move the frame.

20 Claims, 17 Drawing Sheets

(58) Field of Classification Search
IPC ..... A47L 9/00
See application file for complete search history.

(56) References Cited

U.S. PATENT DOCUMENTS

| | | | | |
|---|---|---|---|---|
| 2008/0295270 | A1 | 12/2008 | Lee | |
| 2014/0096340 | A1 | 4/2014 | Lee et al. | |
| 2016/0113458 | A1* | 4/2016 | Song | A47L 9/0411 15/419 |

FOREIGN PATENT DOCUMENTS

| | | | |
|---|---|---|---|
| GB | 2432301 | A | 5/2007 |
| KR | 20-1993-0025018 | U | 12/1993 |
| KR | 10-1999-0038283 | A | 6/1999 |
| KR | 10-0244348 | B1 | 4/2000 |
| KR | 10-2008-0104504 | A | 12/2008 |

OTHER PUBLICATIONS

Written Opinion of the International Searching Authority dated Jul. 27, 2017 in connection with International Patent Application No. PCT/KR2017/004098.
European Patent Office, "Supplementary European Search Report," Application No. EP17789823.6, dated Mar. 14, 2019, 7 pages.

* cited by examiner

VACUUM CLEANER

CROSS-REFERENCE RELATED TO APPLICATIONS

This application is a 371 of International Application No. PCT/KR2017/004098 filed Apr. 17, 2017, which claims priority to Korean Patent Application No. 10-2016-0052231 filed Apr. 28, 2016, the disclosures of which are herein incorporated by reference in their entirety.

BACKGROUND

1. Field

The present disclosure relates to a vacuum cleaner capable of cleaning efficiently.

2. Description of Related Art

A vacuum cleaner is an appliance for performing cleaning by sucking air by a suction force generated by a fan motor and filtering out foreign materials contained in the sucked air. The vacuum cleaner sucks air containing foreign materials on a surface to be cleaned, separates the foreign materials from the sucked air to collect the foreign materials, and then discharges the resultant purified air to the outside of the vacuum cleaner.

The vacuum cleaner is largely classified into a canister type cleaner and an upright type cleaner.

The canister type cleaner includes a main body in which a blowing device and a dust collecting device are installed, a suction portion separated from the main body to suck dust on a surface to be cleaned, and a connection pipe connecting the main body to the suction portion. Therefore, a user grips a handle attached to the connection pipe and moves the suction portion in a desired direction to perform cleaning.

The upright type cleaner includes an upright main body and a suction portion integrally coupled to the lower portion of the main body. Therefore, a user grips a handle provided at the upper portion of the main body and moves the entire upright type cleaner to perform cleaning.

When a user moves the cleaner to clean a hard surface to be cleaned, the suction portion needs to be in close contact with the surface to be cleaned in order to maintain a high suction force.

When the suction portion is in close contact with the surface to be cleaned, the suction portion can move smoothly on the surface to be cleaned, and also can clean the surface efficiently with a high suction force.

However, when the surface to be cleaned is a carpet, the suction portion may not easily move when the suction portion is brought into close contact with the surface to be cleaned to maintain a high suction force. That is, when cleaning the carpet, the user needs to apply great strength to move the suction portion on the surface to be cleaned.

SUMMARY

According to an embodiment, there is provided a vacuum cleaner including a suction portion capable of adjusting a suction force according to a state of a surface to be cleaned.

Also, there is provided a vacuum cleaner capable of improving performance by adjusting a degree of close contact between a surface to be cleaned and a suction portion according to a state of the surface to be cleaned.

In accordance with an aspect of the present disclosure, a vacuum cleaner includes a suction portion configured to suck foreign materials on a surface to be cleaned. The suction portion includes a case having an air hole formed on a flow path, a frame accommodated in the case, and configured to open or close the air hole, and a button mounted on the case, and configured to be operated to move the frame.

When the frame moves upward, the air hole may be opened, and when the frame moves downward, the air hole may be closed.

An elastic member may be disposed inside the case to provide an elastic force in a direction of pushing the frame upward.

When one side of the button is pressed, the frame may move upward, and when the other side of the button is pressed, the frame may move downward.

The frame may include a protruding portion configured to close the air hole.

An interference rib may protrude from the button, and a sliding portion contacting the interference rib is provided in the case.

When the button is pressed, the interference rib may move in one direction or in the other direction along the sliding portion.

The sliding portion may include a first sliding portion extending in one direction and a second sliding portion bent downward from the first sliding portion.

The vacuum cleaner may further include an elastic member configured to provide an elastic force to the frame, and the elastic member provides an elastic force so that the interference rib is fixed in a state of being positioned in the first sliding portion or the second sliding portion.

A brush which is in contact with the surface to be cleaned may be disposed on a bottom of the frame.

A blade having the same height as the brush may be disposed on the bottom of the frame.

The brush and the blade may be located along an outer circumference of the bottom of the frame.

A hole into which the brush and the blade are inserted may be formed in a bottom of the case.

A bottom of the case may include a first surface that is in contact with the surface to be cleaned, and a second surface recessed upward from the first surface.

The air hole may be located at a side of the second surface.

In accordance with an aspect of the present disclosure, a vacuum cleaner includes a case including a suction port configured to suck foreign materials on a surface to be cleaned, and an air hole formed at an side of the suction port, a frame accommodated in the case, and configured to open or close the air hole, an interference rib configured to press the frame in one direction, and an elastic member configured to provide an elastic force to the frame in the opposite direction.

The frame may move in the one direction to close the air hole, and moves in the opposite direction to open the air hole.

A brush which is in contact with the surface to be cleaned may be disposed on a bottom of the frame.

When the frame moves in the one direction, the brush may be accommodated in the case, and when the frame moves in the opposite direction, the brush may protrude from the case.

A hole into which the brush is inserted may be formed in a bottom of the case.

According to a vacuum cleaner of an embodiment, by opening or closing a hole formed in a suction portion according to a state of a surface to be cleaned, it may be possible to perform cleaning efficiently.

Also, by opening a hole provided in a suction portion, a user may move the suction portion easily on a surface to be cleaned, such as a carpet.

DETAILED DESCRIPTION

Hereinafter, a vacuum cleaner according to an embodiment will be described in detail with reference to the drawings.

Figure 1:
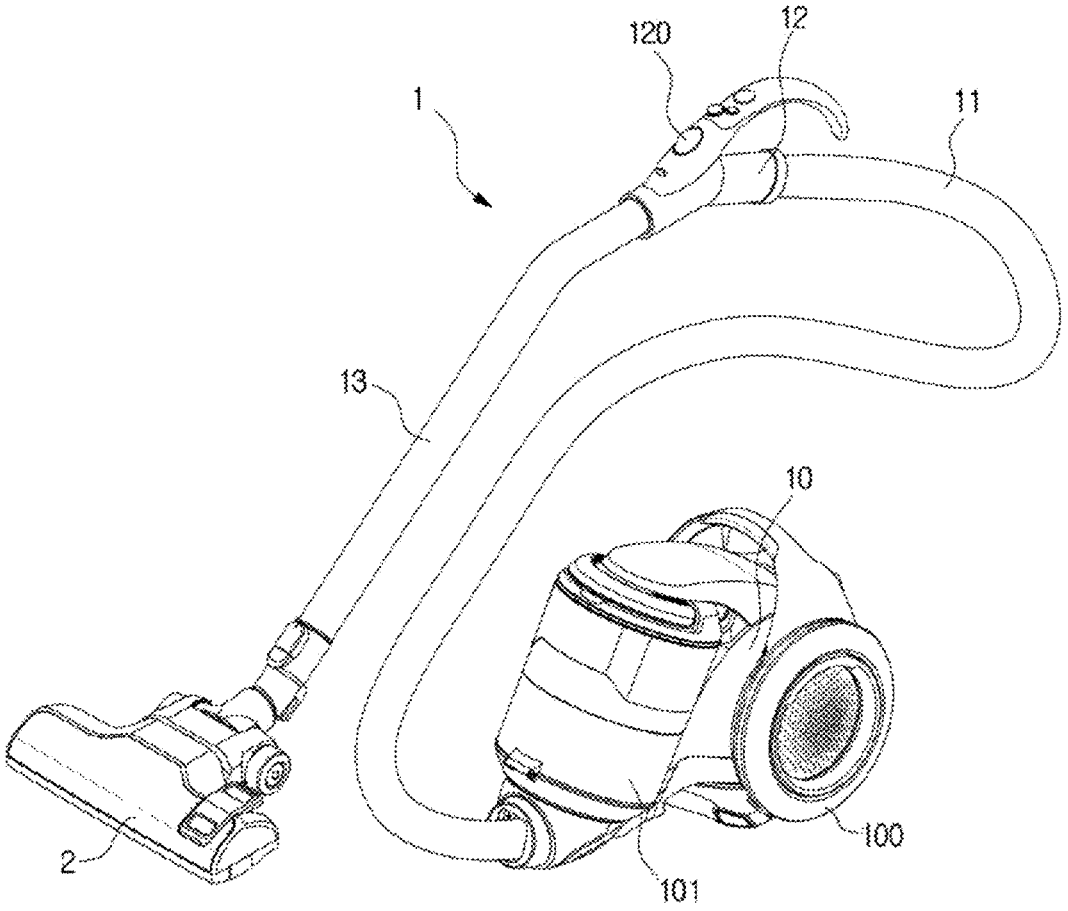
FIG. 1 is a perspective view illustrating a vacuum cleaner according to one embodiment.

FIG. 1 is a perspective view of a vacuum cleaner according to an embodiment.

Referring to FIG. 1, a vacuum cleaner 1 according to an embodiment may be a canister type cleaner. The vacuum cleaner 1 may include a main body 10, a dust collecting apparatus 101 installed in the main body 10, and a suction portion 2 contacting a surface to be cleaned.

The main body 10 may include a fan motor (not shown) for generating a suction force. The suction portion 2 may suck foreign materials on the surface to be cleaned by the suction force generated in the main body 10. The suction portion 2 may be configured to be in close contact with the surface to be cleaned.

The main body 10 may include a wheel 100 for driving the main body 10. The wheel 100 may be disposed at both sides of the main body 10. The wheel 100 may be movable in one direction. The body 10 may further include a caster (not shown) that is rotatable in all directions.

The suction portion 2 may be connected to the main body 10 by an extension pipe 13 made of a resin or metal and a hose 11 which is flexible. A handle pipe 12 may be further provided between the extension pipe 13 and the hose 11. The extension pipe 13, the handle pipe 12, and the hose 11 may communicate with each other. Air sucked through the suction portion 2 may pass through the extension pipe 13, the handle pipe 12 and the hose 11 sequentially to enter the dust collecting apparatus 101.

A user may grip the handle pipe 12, and move it to move the suction portion 2. The handle pipe 12 may include a controller 120 for controlling operations of the vacuum cleaner 1. The controller 120 may include a plurality of buttons, a switch, a dial, and the like.

The dust collecting apparatus 101 may be a cyclone dust collecting apparatus that generates a swirling airstream to separate foreign materials from air by a centrifugal force. The air from which foreign materials are separated in the dust collecting apparatus 101 may escape to the outside through a discharge port. The dust collecting apparatus 101 may be detachable from the main body 10 in order to throw away foreign materials collected therein.

The suction portion 2 may be in contact with the surface to be cleaned so as to suck foreign materials on the surface to be cleaned together with air. When the suction portion 2 is in close contact with the surface to be cleaned, the suction portion 2 may efficiently suck foreign materials on the surface to be cleaned with a high suction force. When the suction portion 2 is in close contact with the surface to be cleaned and there is no gap between the suction portion 2 and the surface to be cleaned, the suction portion 2 may suck foreign materials on the surface to be cleaned using the maximum of a suction force generated by the fan motor.

The surface which the suction portion 2 is in contact with may be a hard surface or a carpet. When the suction portion 2 is in contact with a hard surface such as a floor, the suction portion 2 may slide easily on the hard surface while being in contact with the hard surface. That is, a user may move the suction portion 2 with a small force even when the suction portion 2 is in close contact with the hard surface.

However, when the suction portion 2 is in contact with a carpet, the inside of the suction portion 2 may be hermetically sealed by a suction force when the suction portion 2 is in close contact with the carpet, so that the suction portion 2 may not easily slide on the carpet. In this case, the user may need to apply great strength to move the suction portion 2 when cleaning the carpet.

According to a typical technique, a suction portion may be configured to make a predetermined gap with a surface to be cleaned in order to clean a surface to be cleaned, such as a carpet, while easily moving the suction portion 2 on the surface to be cleaned. In this case, although the mobility of the suction portion is improved, efficiency in cleaning a hard floor surface may be reduced.

The present disclosure discloses a vacuum cleaner capable of adjusting a degree of contact between the suction portion 2 and a surface to be cleaned according to a state of the surface to be cleaned, thereby improving cleaning efficiency and improving mobility on the surface to be cleaned.

Hereinafter, a structure of the suction portion 2 provided in the vacuum cleaner 1 of the present disclosure will be described in detail with reference to the drawings.

Figure 2:
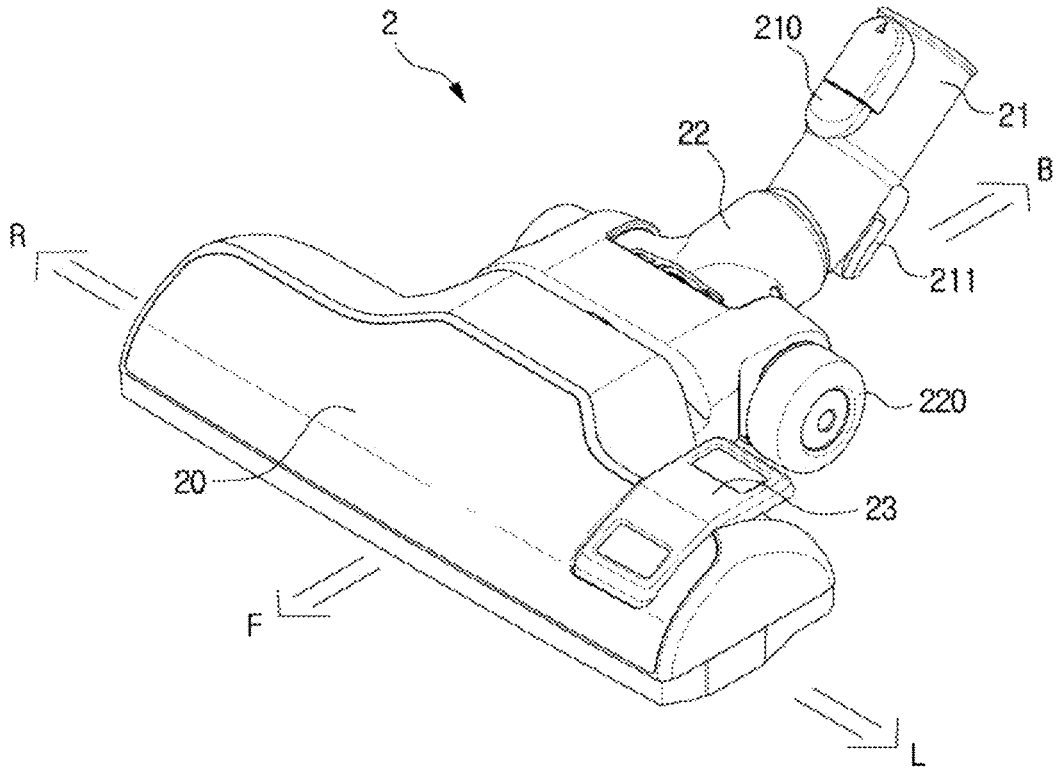
FIG. 2 is a perspective view illustrating a suction portion of a vacuum cleaner according to one embodiment.
Figure 3:
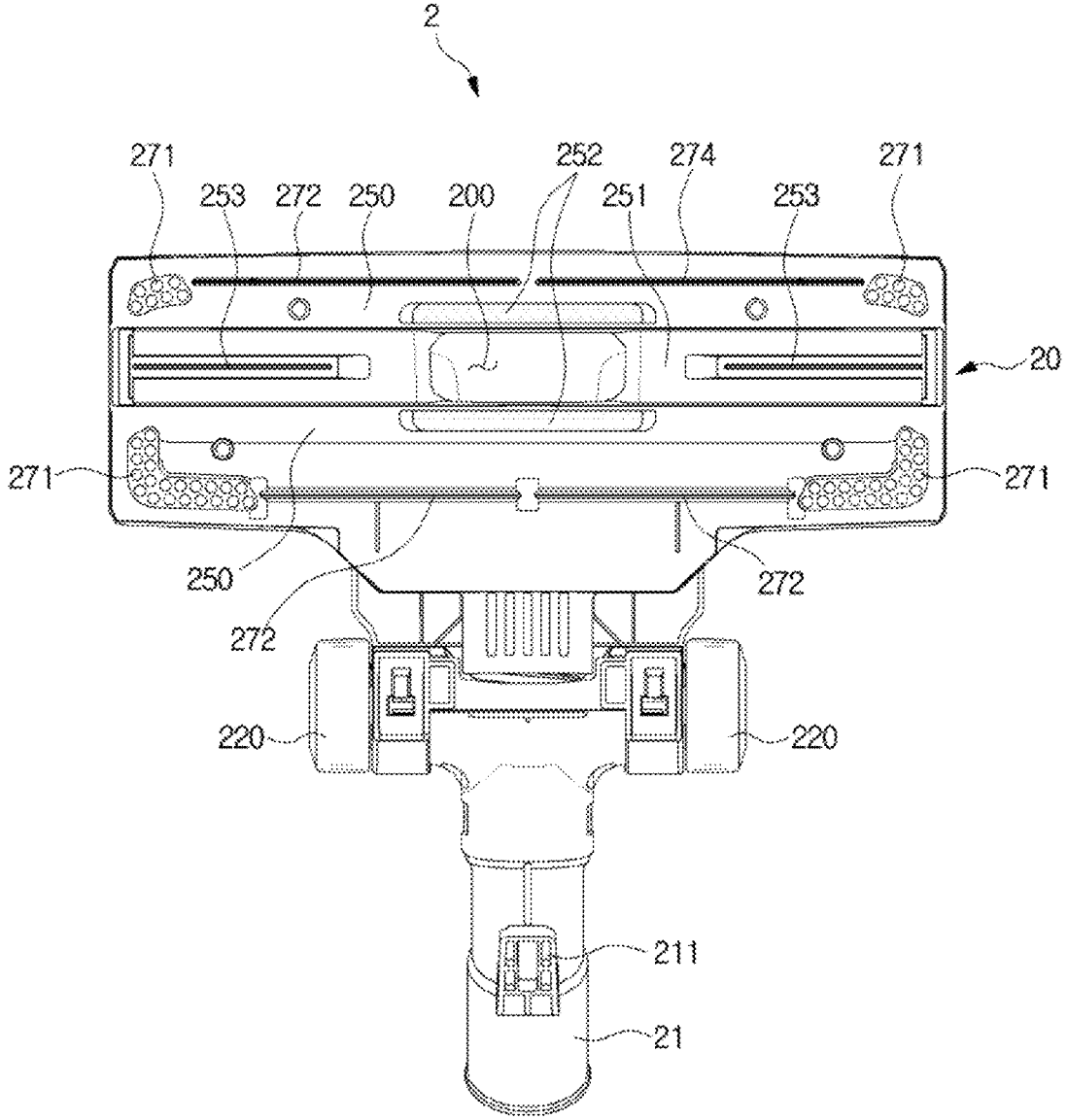
FIG. 3 is a bottom view of a suction portion of a vacuum cleaner according to one embodiment.
Figure 4:
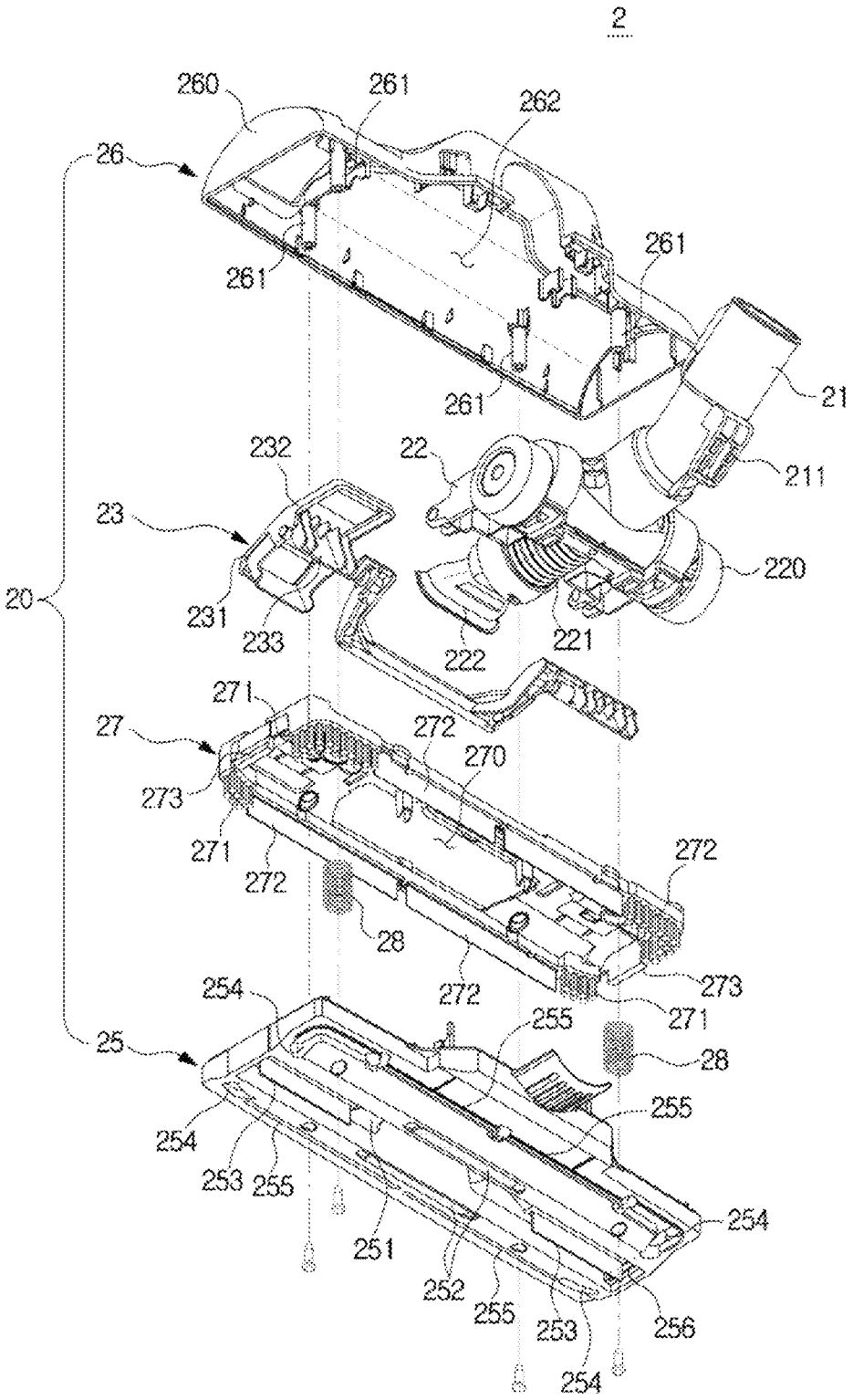
FIG. 4 is an exploded perspective view illustrating a suction portion of a vacuum cleaner according to one embodiment.

FIG. 2 is a perspective view of a suction portion of a vacuum cleaner according to an embodiment, and FIG. 3 is a bottom view of a suction portion of a vacuum cleaner according to an embodiment, and FIG. 4 is an exploded perspective view of a suction portion of a vacuum cleaner according to an embodiment.

Referring to FIGS. 2 to 4, the suction portion 2 according to an embodiment may include a contact portion 20 contacting a surface to be cleaned, a connection pipe 21 connected to the extension pipe 13 (see FIG. 1), and a connection portion 22 connecting the contact portion 20 to the connection pipe 21. The connection pipe 21 may be pivotally connected to the contact portion 20 to pivot in one direction or in a plurality of directions with respect to the contact portion 20.

The connection pipe 21 may include a coupling portion 210 for connecting the connection pipe 21 to the extension pipe 13. The connection pipe 21 may include a hook 211 for fixing the connection pipe 21 connected to the extension pipe 13 at a fixing portion (not shown) provided on the main body 10.

The connection portion 22 may include a wheel 220 for moving the contact portion 20 easily on the surface to be cleaned. When the contact portion 20 moves on the surface to be cleaned, the wheel 220 may travel on the surface to be cleaned. Two wheels 220 may be disposed at both the left and right sides of the connection portion 22.

The connection portion 22 may include an inlet 222 that communicates with the connection pipe 21. Foreign materials on the surface to be cleaned may be sucked through a suction port 200 formed in the contact portion 20 by suction force generated by the fan motor, flow into the inlet 222, and then move to the dust collecting apparatus 101 through the connection pipe 21, the extension pipe 13, and the hose 11.

The inlet 222 may be connected to the connection pipe 21 by a flexible hose 221. For example, the inlet 222 may be connected to the connection pipe 21 by an accordion corrugated hose 221. In this way, the inlet 222 may be pivotally connected to the connection pipe 21 by the flexible hose 221.

The contact portion 20 may include a button 23 for adjusting a degree of contact between the contact portion 20 and the surface to be cleaned. The user may operate the button 23 according to a state of a floor surface to open or close a plurality of air holes 256 formed in the contact portion 20. The configuration of the button 23 will be described in detail, later.

The contact portion 20 may include a lower case 25, an upper case 26, and a frame 27. The frame 27 may be positioned between the upper case 26 and the lower case 25. The frame 27 may move toward the upper case 26 or the lower case 25 by an operation of the button 23.

In the frame 27, a hole 270 may be formed to communicate with the suction port 200.

On one surface of the frame 27, a blade 272 may protrude to prevent a suction force of the fan motor from being lost. The blade 272 may extend toward the lower case 25 when the frame 27 is accommodated in space formed by the upper case 26 and the lower case 25.

The blade 272 may be disposed along an outer circumference of the frame 27. For example, two blades 272 may extend along both outer sides of the frame 27, which are opposite to each other with the hole 270 in between. That is, a plurality of blades 272 may extend along the outer circumference of the frame 27.

A brush 271 may be disposed on one surface of the frame 27. The brush 271 may extend in the same direction as the blade 272. That is, when the frame 27 is accommodated in the space formed by the upper case 26 and the lower case 25, the brush 271 may protrude toward the lower case 25. The brush 271 may be disposed at an outer corner of the frame 27.

The brush 271 and the blade 272 may be positioned along the outer circumference of one surface of the frame 27. When moving directions of the contact portion 20 are referred to as forward and backward directions (F and B directions), the blade 272 may extend along the front (F) and rear (B) circumferences of the frame 27. The brush 271 may be disposed at the corner of the front (F) or rear (B) portion of the frame 27.

The brush 271 and the blade 272 may have the same height from one surface of the frame 27.

When the frame 27 moves toward the lower case 25 by the button 23, the brush 271 and the blade 272 may be in close contact with the surface to be cleaned to minimize loss of a suction force between the surface to be cleaned and the contact portion 20.

The frame 27 may move in the upper case 26 and the lower case 25 to open or close the air holes 256 formed in the lower case 25. For example, the frame 27 may include a plurality of protrusions 273 for opening or closing the air holes 256 formed in the lower case 25. The protrusions 273 may extend along the outer circumference of the frame 27. The protrusions 273 may be disposed at the left (L) and right (R) sides of the surface of the frame 27 to correspond to the positions of the air holes 256, respectively. However, the positions of the protrusions 273 and the air holes 256 are not limited to those described above.

The lower case 25 may have the suction port 200. The suction port 200 may be formed at a center of the lower case 25. The lower case 25 may have a stepped portion extending in the left and right directions (L and R directions). More specifically, the lower case 25 may include a first surface 250 that is in contact with the surface to be cleaned, and a second surface 251 recessed upward from the first surface 250. The suction port 200 may be positioned at a center of the second surface 251. The second surface 251 may extend in the left and right directions (L and R directions) of the lower case 25 with respect to the moving directions of the contact portion 20.

In the outer circumference of the first surface 250, a first insertion hole 254 and a second insertion hole 255 may be formed into which the brush 271 and the blade 272 provided in the frame 27 are inserted. The first insertion hole 254 may be formed at an outer corner of the first surface 250 to correspond to the brush 271. The second insertion hole 255 may extend along the outer circumference in front-back direction of the first surface 250 to correspond to the blade 272.

The first surface 250 may include a cleaning portion 252 which is in contact with the surface to be cleaned. The cleaning portion 252 may be positioned in the front-rear direction of the lower case 25 with respect to the suction port 200. The cleaning portion 252 may be a relatively short haired fabric. The hair of the cleaning portion 252 may extend in an oblique direction. In detail, the hair of the cleaning portion 252 located at the front portion of the lower case 25 may extend rearward, and the hair of the cleaning portion 252 located at the rear portion of the lower case 25 may extend forward.

The cleaning portion 252 may be in contact with the surface to be cleaned, such as a carpet, and may capture foreign materials (for example, animal hair) which exist on the surface to be cleaned and are not easily detached from the surface to be cleaned, thereby easily detaching the foreign materials from the surface to be cleaned. The foreign materials detached from the surface to be cleaned may be sucked into the suction port 200 by a suction force of the fan motor.

The second surface 251 may include a friction member 253 made of a flexible material such as rubber. The friction member 253 may be more or less longer than a length from the second surface 251 to the first surface 250. When the friction member 20 moves along the carpet, the friction member 253 may rub against the carpet to raise foreign materials existing on the carpet. Then, the foreign materials may be easily sucked through the suction port 200. By the friction member 253, foreign materials existing on the carpet may be easily removed.

The air holes 256 may be formed at one side of the lower case 25. The air holes 256 may be formed on a flow path of the suction portion 2. According to the current embodiment, the air holes 256 may be formed at sides of the lower case 25 where the second surface 251 is located. The air holes 256 may be opened and closed by the frame 27 in accordance with an operation of the button 23. More specifically, the air holes 256 may be opened or closed by the protrusions 273 provided in the frame 27.

In the upper case 26, inner space 262 in which the frame 27 is accommodated may be formed. An elastic member mounting portion 261 on which an elastic member 28 is mounted may be provided on the bottom of the upper case 26. The elastic member mounting portion 261 may protrude from the bottom of the upper case 26. The elastic member 28 may be mounted on the elastic member mounting portion 261 to provide an elastic force for pushing the frame 27 toward the upper case 26.

The button 23 may include pressing portions 231 and 232 that are pressed by a user. The pressing portions 231 and 232 may include a first pressing portion 231 and a second pressing portion 232 extending with a predetermined inclination from the first pressing portion 231. The second pressing portion 232 may be integrated into the first pressing portion 231.

A plurality of interference ribs 233 may protrude from bottoms of the pressing portions 231 and 232. A user may press the first pressing portion 231 or the second pressing portion 232 to move the frame 27 toward the upper case 26 or the lower case 25.

Hereinafter, a configuration in which the frame 27 moves toward the upper case 26 or the lower case 25 by an operation of the button 23 will be described.

Figure 5:
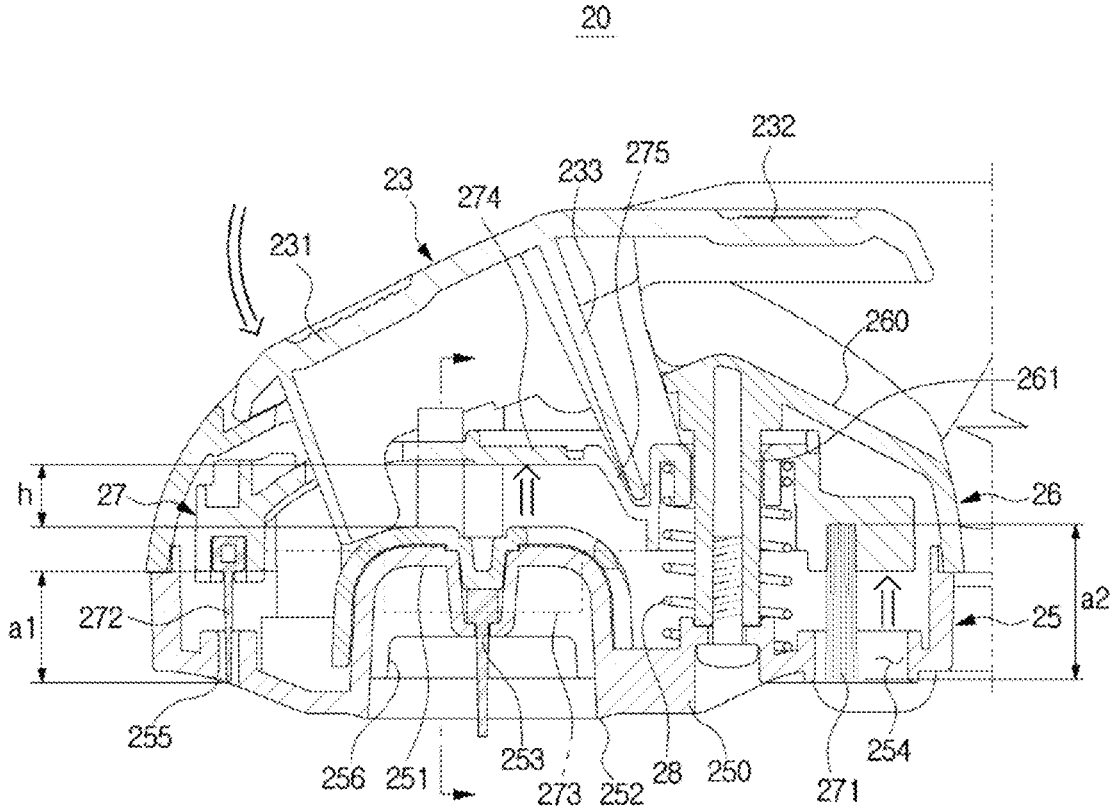
FIGS. 5 and 6 are views illustrating a state in which a button of a suction portion according to one embodiment is operated.
Figure 6:
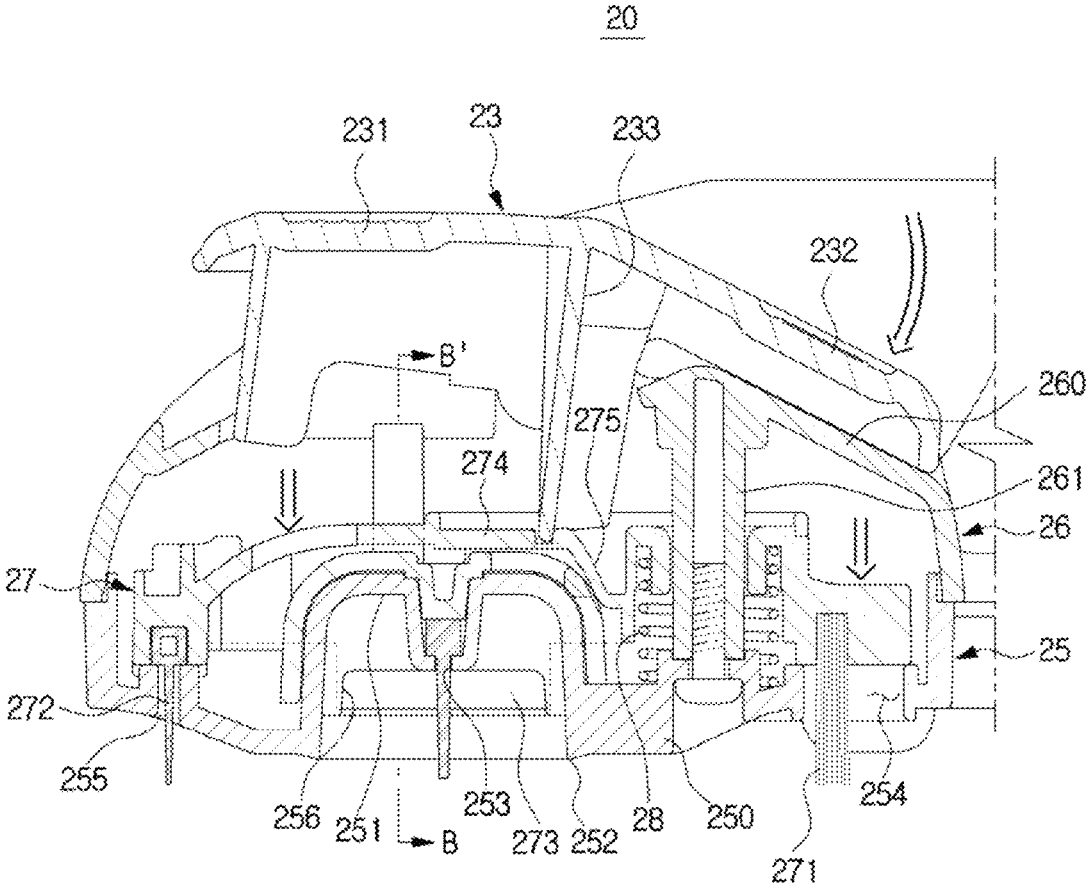

FIGS. 5 and 6 show states in which a button of a suction portion according to an embodiment is operated.

Referring to FIGS. 5 and 6, the button 23 according to an embodiment may include the pressing portions 231 and 232 and the interference ribs 233 protruding from the bottoms of the pressing portions 231 and 232. The pressing portions 231 and 232 may include a first pressing portion 231 and a second pressing portion 232 bent from the first pressing portion 231. The first pressing portion 231 and the second pressing portion 232 may be arranged in the front-rear direction. For example, the first pressing portion 231 may be positioned in front of the second pressing portion 232.

A user may press the first pressing portion 231 or the second pressing portion 232 to move the frame 27 toward the upper case 26 or the lower case 25 depending on a state of the surface to be cleaned.

The frame 27 may include sliding portions 274 and 275 having a bent shape. When the user presses the pressing portions 231 and 232, the interference ribs 233 may move along the sliding portions 274 and 275 provided in the frame 27.

The sliding portions 274 and 275 may include a first sliding portion 274 extending in one direction and a second sliding portion 275 bent downward in a diagonal direction from the first sliding portion 274. For example, the first sliding portion 274 may extend in the front-rear direction, and the second sliding portion 275 may extend toward the lower rear portion of the first sliding portion 274.

When the user presses the first pressing portion 231 or the second pressing portion 232, the interference ribs 233 may move along the sliding portions 274 and 275 provided in the frame 27.

When the user presses the first pressing portion 231, ends of the interference rib 233 may slide along the second sliding portion 275. A height h in vertical direction by which the interference ribs 233 move along the second sliding portion 275 may be equal to or more or less shorter than a length a1 of the blade 272 provided in the frame 27 or a length a2 of the brush 271.

When the interference ribs 233 are positioned on the second sliding portion 275, the frame 27 may rise by the height h by which the interference ribs 233 are lowered, since the elastic member 28 provides an elastic force in a direction of pushing the frame 27 upward. Even when the force applied to the first pressing portion 231 is removed, the interference ribs 233 may be fixed so as not to move in a state of being positioned on the second sliding portion 275. Thereby, the button 23 may maintain the pressed state of the first pressing portion 231, and the frame 27 may move toward the upper case 26.

The blade 272 and the brush 271 mounted on the frame 27 may also move upward together with the frame 27. More specifically, the blade 272 and the brush 271 may be inserted into the space formed by the upper case 26 and the lower case 25.

When the user presses the second pressing portion 232, the ends of the interference ribs 233 may slide along the first sliding portion 274 via the second sliding portion 275. In this case, the frame 27 may rise by the height h by which the interference ribs 233 has risen. When the interference ribs 233 are positioned on the first sliding portion 274, the frame 27 may move toward the lower case 25. The interference ribs 233 may be fixed so as not to move on the first sliding portion 274 by an elastic force of the elastic member 28. The button 23 may maintain the pressed state of the second pressing portion 232. The blade 272 and the brush 271 mounted on the frame 27 may protrude to the bottom of the lower case 25.

Figure 7:
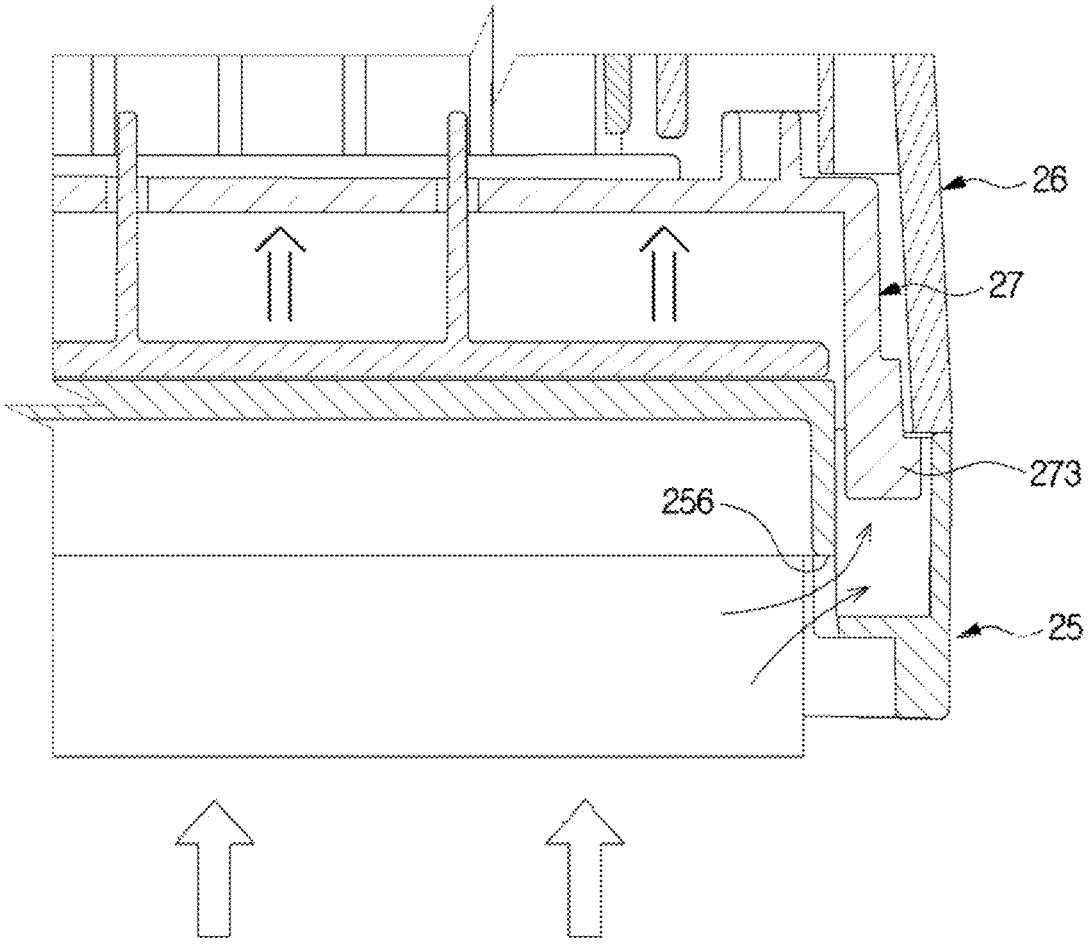
FIGS. 7 and 8 are views illustrating a state of an air hole according to an operation of a button according to one embodiment.
Figure 8:
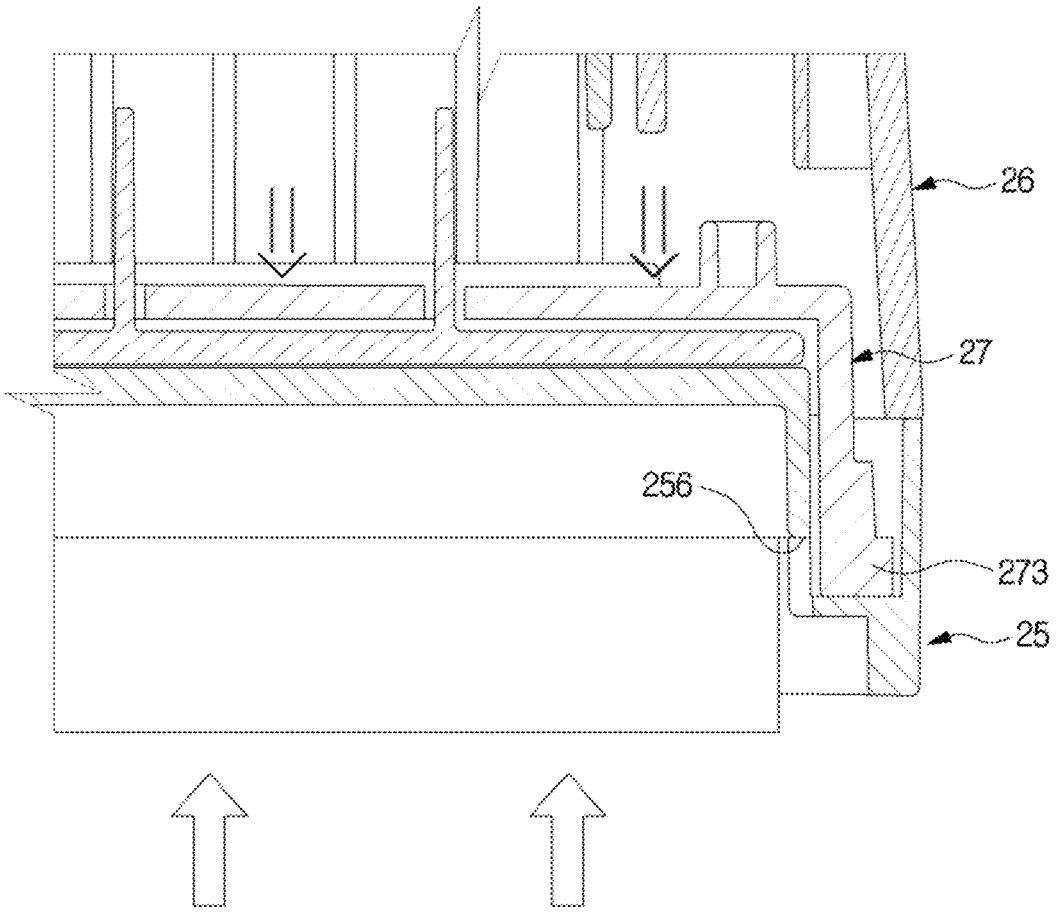

FIGS. 7 and 8 show states of an air hole according to operations of a button according to an embodiment.

Referring to FIGS. 7 and 8, when the first pressing portion 231 of the button 23 according to an embodiment is pressed, the frame 27 may move upward. When the frame 27 moves upward, the protrusions 273 provided on the frame 27 may also move upward, and the air holes 256 formed in the lower case 25 may open.

When the second pressing portion 232 of the button 23 is pressed, the frame 27 may move downward. When the frame 27 moves downward, the protrusions 273 provided on the frame 27 may also move downward, and the air holes 256 may be closed by the protrusions 273.

Figure 9:
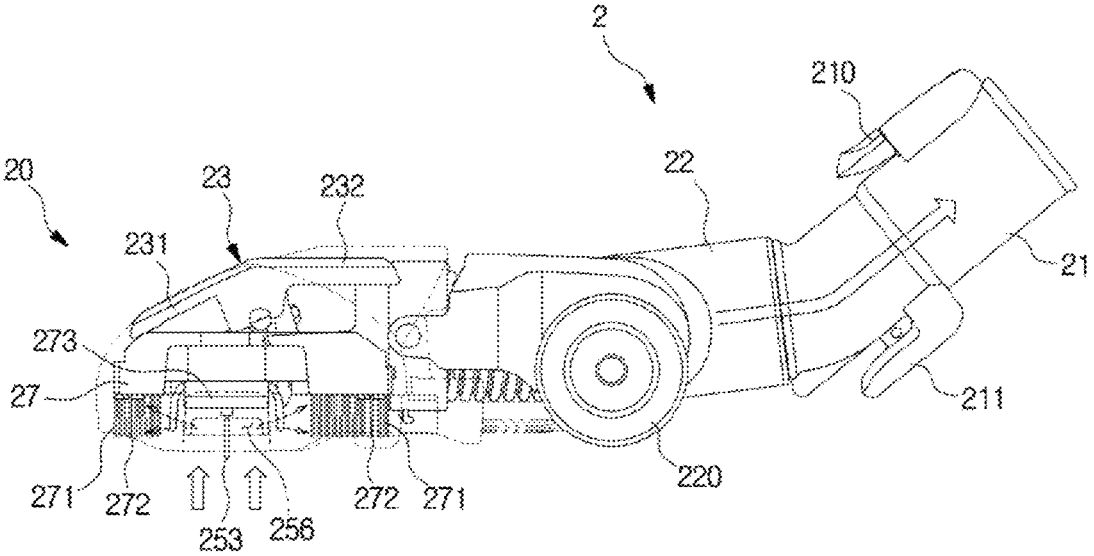
FIGS. 9 and 10 are views illustrating a suction portion according to an operation of a button according to one embodiment.
Figure 10:
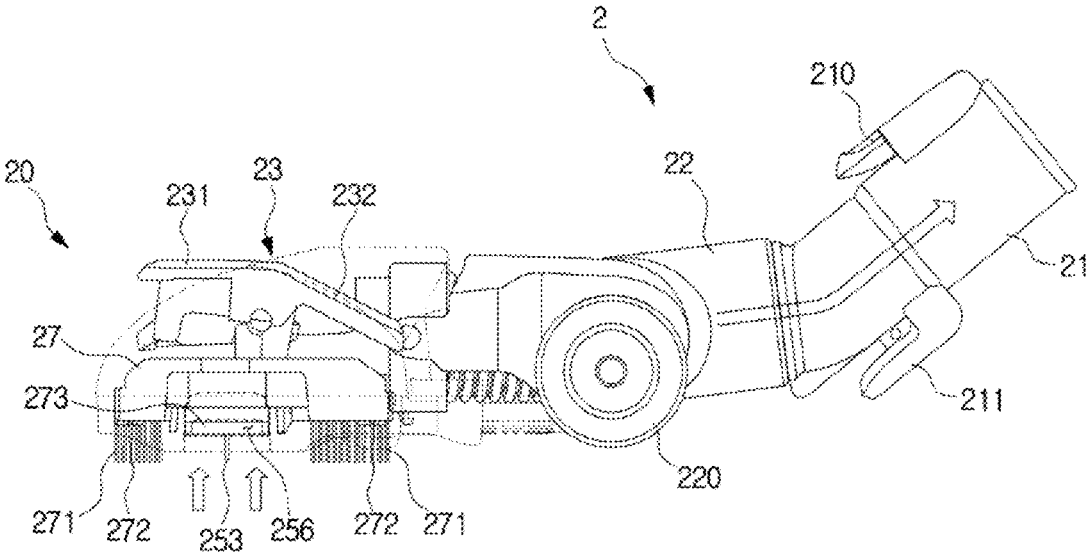

FIGS. 9 and 10 show states of a suction portion according to operations of a button according to an embodiment.

Referring to FIGS. 9 and 10, when a surface to be cleaned is a carpet, the user may press the first pressing portion 231 of the button 23 to open the air holes 256. In this case, the frame 27 may move upward so that the blade 272 and the brush 271 are inserted into the inside space of the contact portion 20. The first surface 250 of the lower case 25 may be in contact with the carpet which is the surface to be cleaned.

Figure 11:
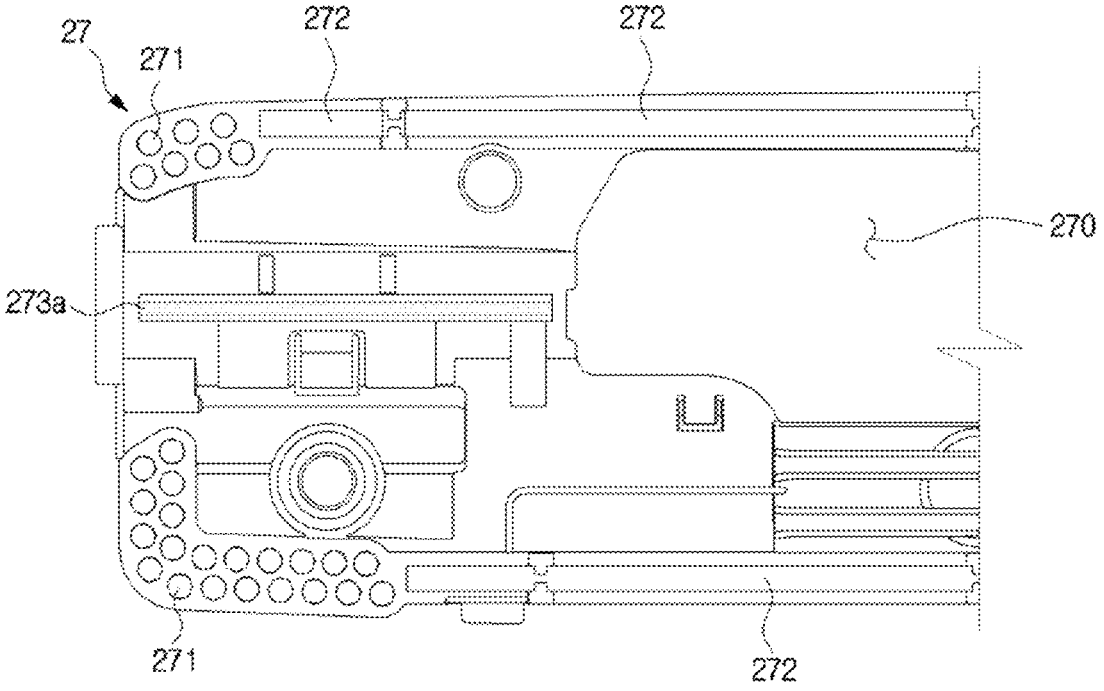
FIG. 11 is a bottom view of a frame according to another embodiment.
Figure 12:
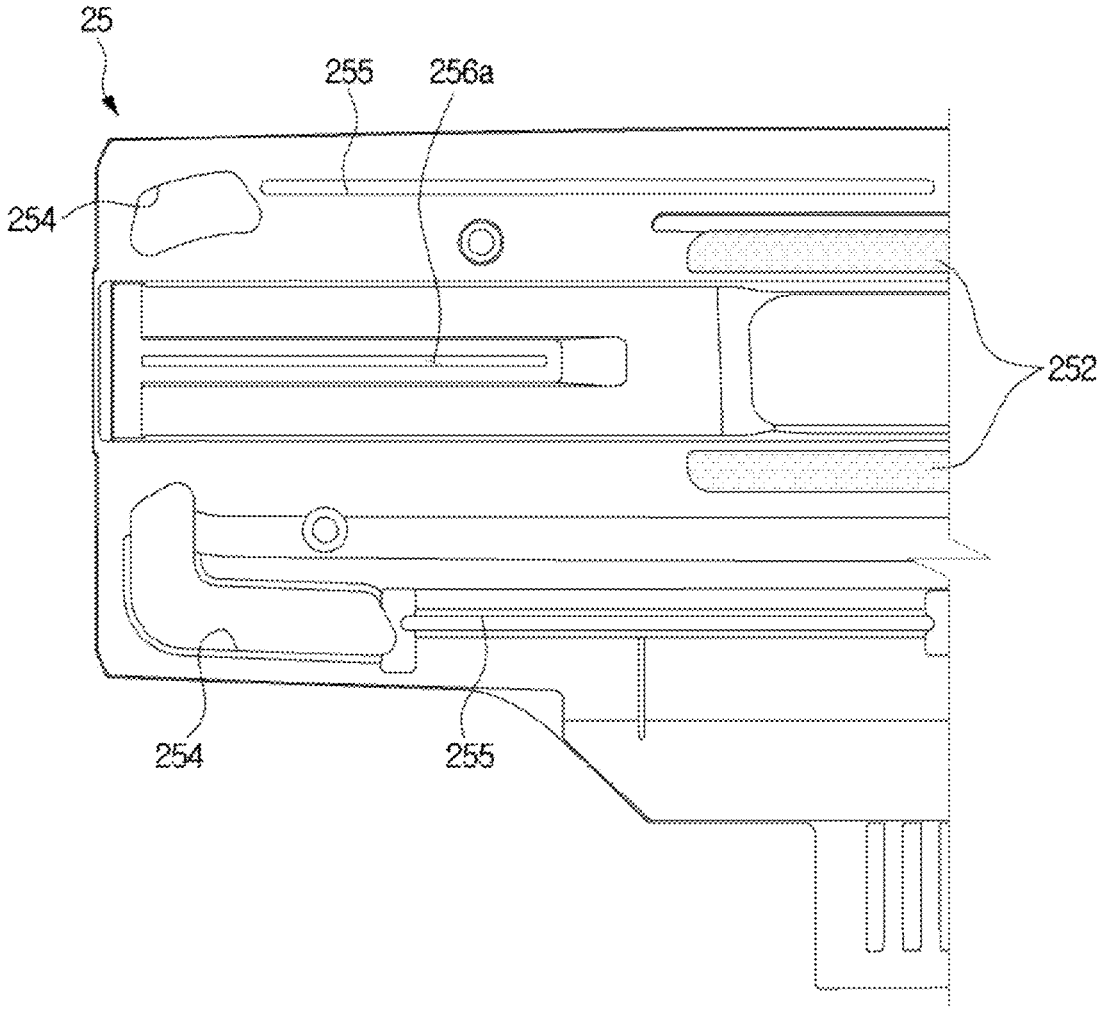
FIG. 12 is a bottom view of a lower case according to another embodiment.
Figure 13:
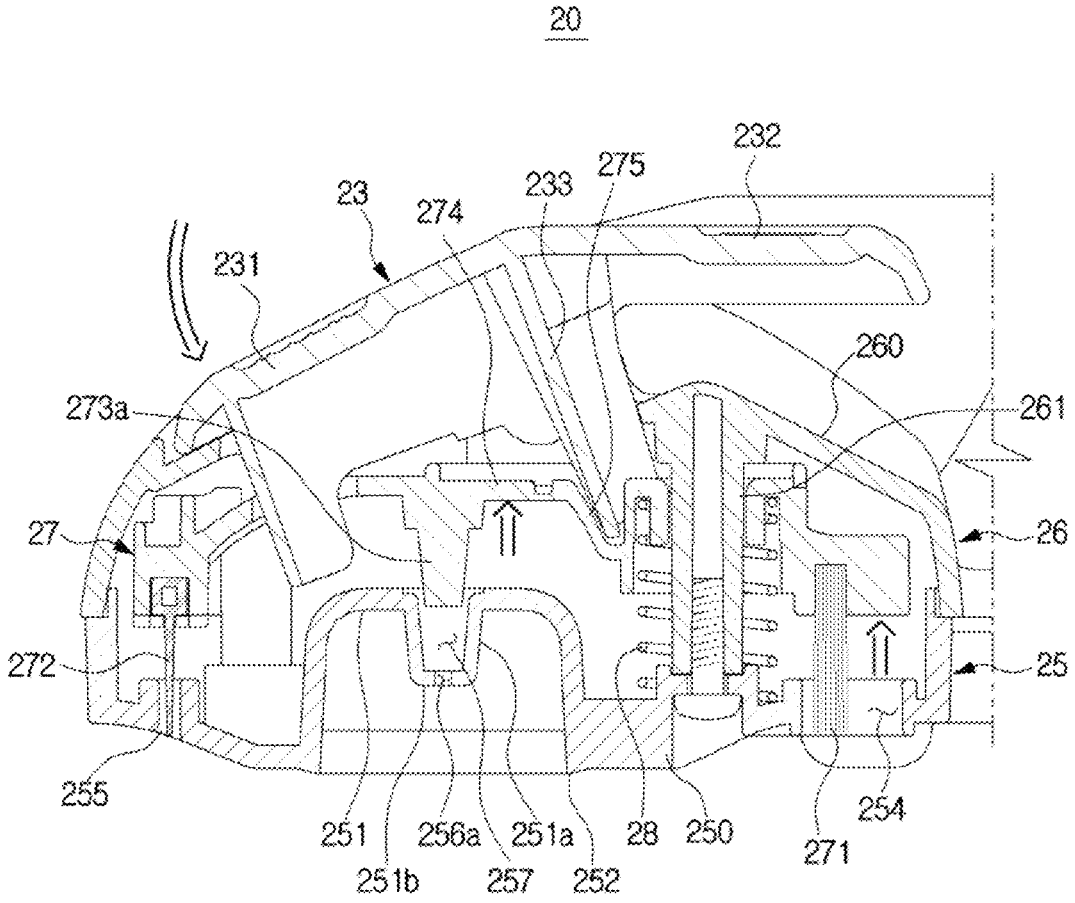
FIGS. 13 and 14 are views illustrating a state in which a button of a suction portion according to another embodiment is operated.
Figure 14:
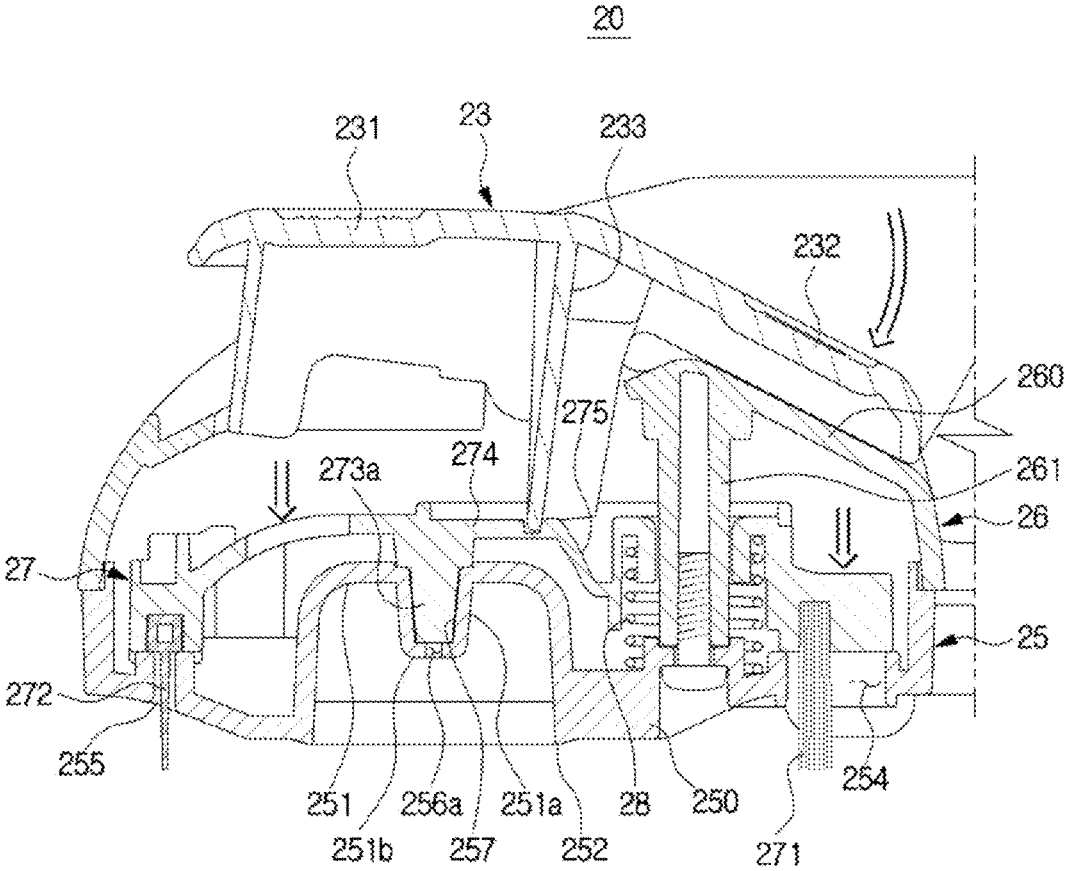

FIG. 11 is a bottom view of a frame according to another embodiment. FIG. 12 is a bottom view of a lower case according to another embodiment. FIGS. 13 and 14 show states in which a button of a suction portion according to another embodiment is operated.

An air hole 256*a* may be formed at one side of the lower case 25. The air hole 256*a* may be formed on a flow path of the suction portion 2. The air hole 256*a* may be formed on an upper area of the flow path.

Referring to FIGS. 13 and 14, the lower case 25 may include an extension surface 251*a* extending downward from the second surface 251, and a third surface 251*b* extending in a horizontal direction from the extension surface 251*a*. The third surface 251*b* may be lower than the second surface 261.

A groove 257 may be formed by the third surface 251*b* and the extension surface 251*a*. A protrusion 273*a* may be inserted into the groove 257.

The air hole 256*a* may be formed in the third surface 251*b*. The air hole 256*a* may extend in the left and right directions (L and R directions), as shown in FIG. 12.

The frame 27 may include a protrusion 273*a* for opening or closing the air hole 256*a* formed in the lower case 25. The protrusion 273*a* may be formed on the flow path of the suction portion 2 to correspond to the position of the air hole 256*a*. In the current embodiment, the protrusion 273*a* may be provided in the upper area of the flow path. The protrusion 273*a* may be provided at both sides of the hole 270 of the frame 27. The protrusion 273*a* may be disposed in parallel to the blade 272. The protrusion 273*a* may be provided at the left and right portions of one surface of the frame 27 respectively to correspond to the position of the air hole 256*a*.

The protrusion 273*a* may protrude downward from the surface of the frame 27. The protrusion 273*a* may move up and down according to an operation of the button 23. When the frame 27 moves downward, the protrusion 273*a* may be inserted into the groove 257 to close the air hole 256*a*. When the frame 27 moves upward, the protrusion 273*a* may escape from the groove 257 to open the air hole 256*a*.

Referring to FIGS. 13 and 14, a button 23 according to another embodiment may include pressing portions 231 and 232 and interference ribs 233 protruding from bottoms of the pressing portions 231 and 232. The pressing portions 231 and 232 may include a first pressing portion 231, and a second pressing portion 232 bent from the first pressing portion 231. The first pressing portion 231 and the second pressing portion 232 may be arranged in the front-rear direction. For example, the first pressing portion 231 may be positioned in front of the second pressing portion 232.

The user may press the first pressing portion 231 or the second pressing portion 232 to move the frame 27 toward the upper case 26 or the lower case 25 depending on a state of a surface to be cleaned.

The frame 27 may include sliding portions 274 and 275 having a bent shape. When a user presses the pressing portions 231 and 232, the interference rib 233 may move along the sliding portions 274 and 275 provided on the frame 27.

The sliding portions 274 and 275 may include a first sliding portion 274 extending in one direction, and a second sliding portion 275 bent downward in a diagonal direction from the first sliding portion 274. For example, the first sliding portion 274 may extend in the front-rear direction, and the second sliding portion 275 may extend toward the lower rear portion of the first sliding portion 274.

When the user presses the first pressing portion 231 or the second pressing portion 232, the interference ribs 233 may move along the sliding portions 274 and 275 provided on the frame 27.

When the user presses the first pressing portion 231, the ends of the interference ribs 233 may slide along the second sliding portion 275. A height h in vertical direction by which the interference ribs 233 move along the second sliding portion 275 may be equal to or more or less shorter than the length a1 of the blade 272 provided in the frame 27 or the length a2 of the brush 271.

When the interference ribs 233 are positioned on the second sliding portion 275, the frame 27 may rise by the height h by which the interference rib 233 is lowered, since the elastic member 28 provides an elastic force in a direction of pushing the frame 27 upward. Even when the force applied to the first pressing portion 231 is removed, the interference rib 233 may be fixed not to move in a state of being positioned on the second sliding portion 275. Thereby, the button 23 may maintain the pressed state of the first pressing portion 231, and the frame 27 may move toward the upper case 26.

The blade 272 and the brush 271 mounted on the frame 27 may move upward together with the frame 27. The blade 272 and the brush 271 may be inserted into the space formed by the upper case 26 and the lower case 25.

When the user presses the second pressing portion 232, the ends of the interference ribs 233 may slide along the first sliding portion 274 via the second sliding portion 275. In this case, the frame 27 may rise by the height h by which the interference ribs 233 rise. When the interference ribs 233 are positioned on the first sliding portion 274, the frame 27 may move toward the lower case 25. The interference ribs 233 may be fixed not to move on the first sliding portion 274 by the elastic force of the elastic member 28. The button 23 may maintain the pressed state of the second pressing portion 232. The blade 272 and the brush 271 mounted on the frame 27 may protrude to the bottom of the lower case 25.

When the first pressing portion 231 of the button 23 is pressed, the frame 27 may move upward. When the frame 27 moves upward, the protrusion 273*a* provided on the frame 27 may also move upward, and the air hole 256*a* formed in the lower case 25 may open.

When the second pressing portion 232 of the button 23 is pressed, the frame 27 may move downward. When the frame 27 moves downward, the protrusion 273*a* provided on the frame 27 may also move downward, and the air hole 256*a* may be closed by the protrusion 273*a*.

When a surface to be cleaned is a carpet, the user may press the first pressing portion 231 of the button 23 to open the air hole 256*a*. In this case, the frame 27 may move upward so that the blade 272 and the brush 271 are inserted into the inside space of the contact portion 20. The first surface 250 of the lower case 25 may be in contact with the carpet which is the surface to be cleaned.

Figure 15:
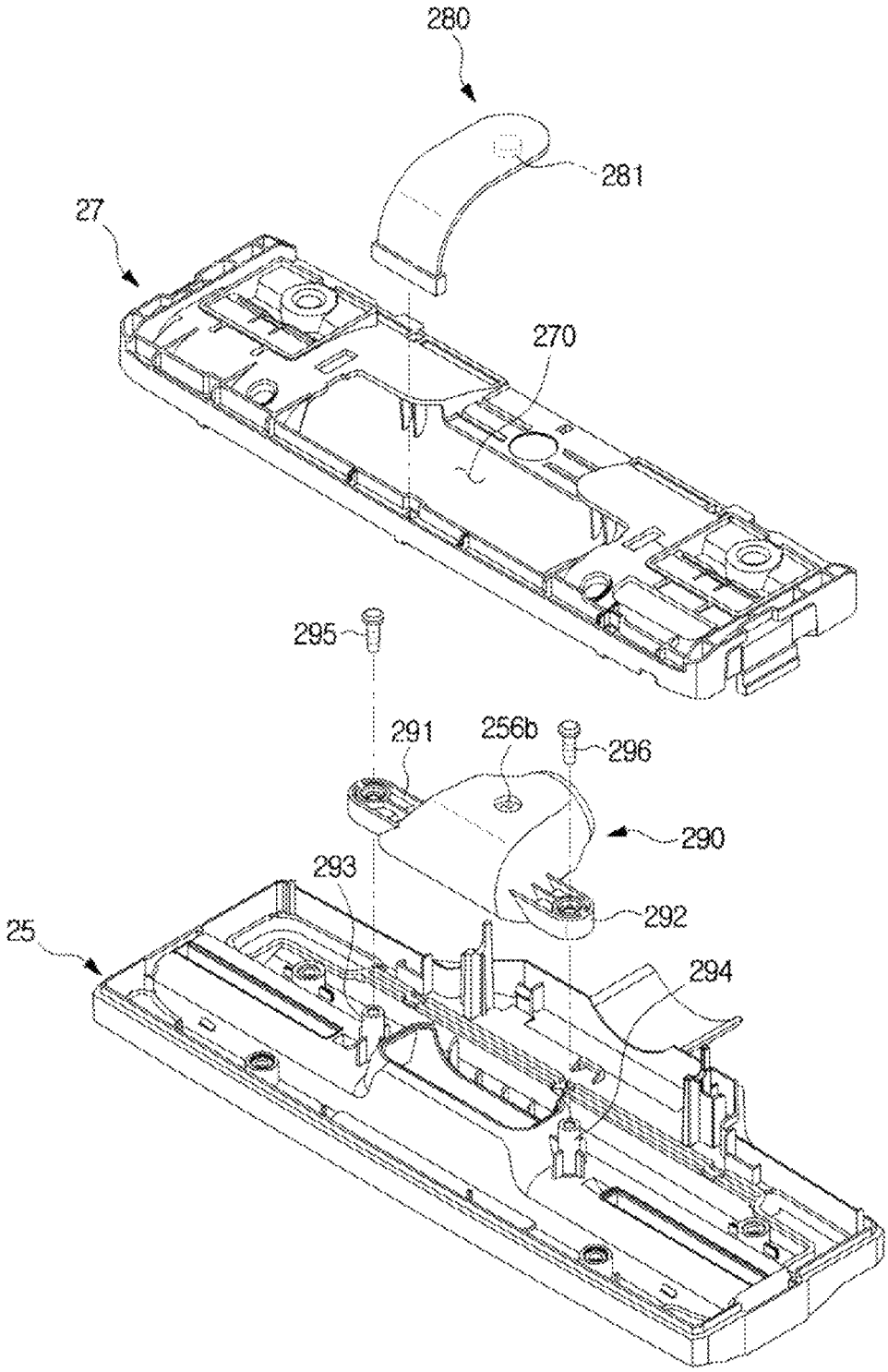
FIG. 15 is a view illustrating a frame and a lower case according to another embodiment.
Figure 16:
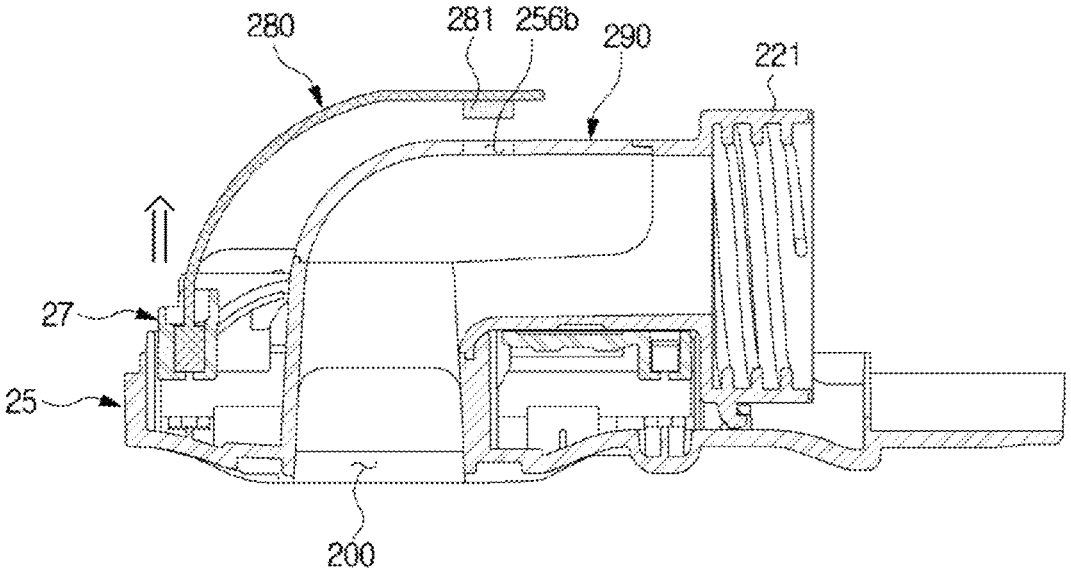
FIGS. 16 and 17 are views illustrating a state in which a button of a suction portion according to another embodiment is operated.
Figure 17:
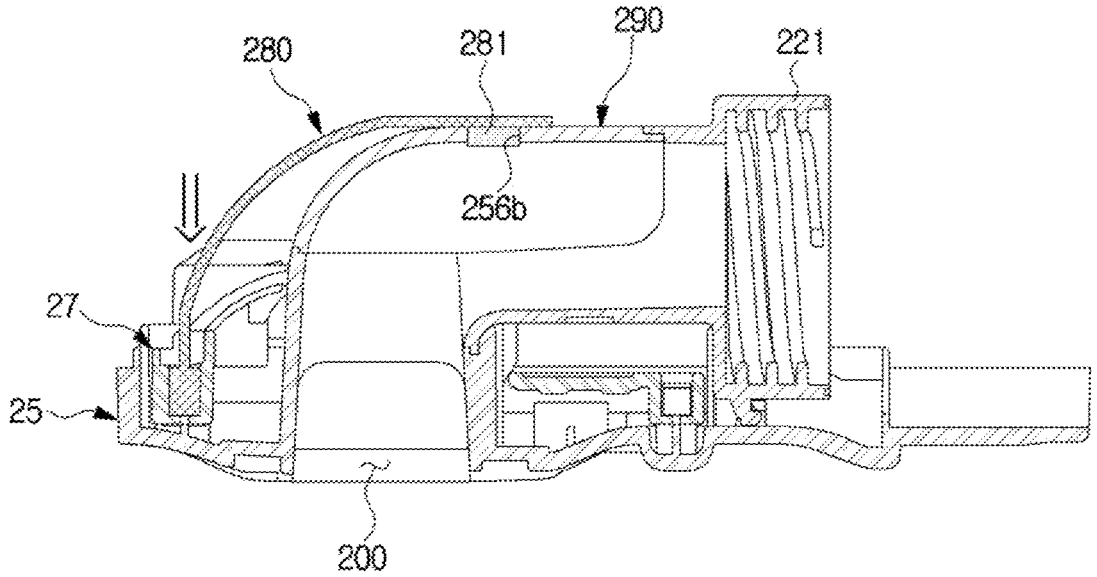

FIG. 15 shows a frame and a lower case according to another embodiment. FIGS. 16 and 17 show states in which a button of a suction portion according to another embodiment is operated.

Referring to FIG. 15, the frame 27 may include a hole 270 that communicates with the suction port 200. The frame 27 may also include an air hole opening and closing member 280. The air hole opening and closing member 280 may be mounted on the front portion of the frame 27. However, the air hole opening and closing member 280 may be integrated into the frame 27.

The air hole opening and closing member 280 may include a protrusion 281 for opening and closing the air hole 256*b*. The protrusion 281 may be formed on one side of the air hole opening and closing member 280. The protrusion 281 may be formed at a position corresponding to the air hole 256*b*. The protrusion 281 may open or close the air hole 256*b* according to an operation of the button 23.

Referring to FIG. 15, the lower case 25 may include a flowpath forming portion 290 disposed above the suction port 200. The flowpath forming portion 290 may connect the suction port 200 and the inlet 222. Mounting portions 291 and 292 may be provided at both sides of the flowpath forming portion 290. The lower case 25 may include boss portions 293 and 294 provided at both sides of the suction port 200. The mounting portions 291 and 292 may be coupled with the boss portions 293 and 294 by fastening members 295 and 296. Thereby, the flowpath forming portion 290 may be fixed at the lower case 25.

An air hole 256*b* may be formed at one side of the flowpath forming portion 290. The air hole 256*b* may be formed on the flowpath of the suction unit 2. The air hole 256*b* may be formed in the upper surface of the flowpath forming portion 290. Referring to FIGS. 16 and 17, the frame 27 may move up and down by a user. As in the other embodiments, when the first pressing portion 231 of the button 23 is pressed, the frame 27 may move upward. When the frame 27 moves upward, the protrusion 281 formed in the frame 27 may also move upward, and the air hole 256*b* formed in the lower case 25 may open.

When the second pressing portion 232 of the button 23 is pressed, the frame 27 may move downward. When the frame 27 moves downward, the protrusion 281 formed in the frame 27 may also move downward, and the air hole 256*b* may be closed by the protrusion 281.

When a surface to be cleaned is a carpet, the user may press the first pressing portion 231 of the button 23 to open the air hole 256*b*. In this case, the frame 27 may move upward so that the blade 272 and the brush 271 are inserted into the inside space of the contact portion 20. The first surface 250 of the lower case 25 may be in contact with the carpet which is the surface to be cleaned.

Generally, when a suction portion is in close contact with a surface to be cleaned such as a carpet, the suction portion and the surface to be cleaned may form sealed space, which makes it difficult to move the suction portion. That is, a user may need to apply great strength to move the suction portion on a surface to be cleaned.

However, according to the present disclosure, when a surface to be cleaned is a carpet, the air holes 256, 256*a*, and 256*b* provided at one side of the contact portion 20 may open to prevent the space formed by the surface to be cleaned and the contact portion 20 from being sealed. Accordingly, the user may clean the carpet with a small force by moving the contact portion 20 easily on the carpet.

The friction member 253 provided on the second surface 251 of the lower case 25 may rub against the carpet to raise foreign materials existing on the carpet. When the fan motor generates a suction force, foreign materials and air may be sucked in and introduced to the inlet 222 and move to the dust collecting apparatus 101 through the connection pipe 21, the extension pipe 13 and the hose 11.

When a surface to be cleaned is a hard surface, the user may press the second pressing portion 232 of the button 23 to close the air holes 256, 256*a*, and 256*b*. When the surface to be cleaned is a hard surface such as a floor and the air holes 256, 256*a*, and 256*b* open, the suction force generated by the fan motor may be lost. Therefore, when the surface to be cleaned is a hard surface, the user may close the air holes 256, 256*a*, and 256*b* to prevent the loss of the suction force.

In this case, the frame 27 may move downward, and the brush 271 and the blade 272 provided in the frame 27 may protrude from the bottom of the lower case 25. The brush 271 may sweep the surface to be surface. The blade 272 may seal the space between the lower case 25 and the surface to be cleaned, in order to prevent the loss of the suction force of the fan motor by the protruding brush 271.

In this way, when the hard surface is cleaned, the air holes 256, 256*a*, and 256*b* may be closed, thereby preventing degradation of cleaning efficiency.

As described above, the vacuum cleaner 1 according to the present disclosure may open or close the air holes 256, 256*a*, and 256*b* provided in the suction portion 2 according to a state of a surface to be cleaned. When cleaning a surface to be cleaned such as a carpet, the vacuum cleaner 1 may open the air holes 256, 256*a* and 256*b* to improve the mobility of the suction portion 2. When cleaning a hard surface such as a floor, the vacuum cleaner 1 may close the air holes 256, 256*a*, and 256*b* to prevent the suction force of the fan motor from being lost.

According to the present disclosure, the vacuum cleaner 1 may prevent degradation of cleaning efficiency, and improve usability.

The invention claimed is:

1. A vacuum cleaner including:

a suction portion configured to suck foreign materials on a surface to be cleaned, wherein the suction portion comprises:

a case having a main flow path and an air hole formed on an auxiliary flow path, a frame accommodated in the case, and configured to open or close the air hole, wherein the frame includes a hole to allow the main flow path to remain open regardless of when the air hole is open or closed, and a button mounted on the case, and configured to be operated to move the frame.

2. The vacuum cleaner according to claim 1, wherein when the frame moves upward, the air hole is opened, and when the frame moves downward, the air hole is closed.

3. The vacuum cleaner according to claim 1, wherein an elastic member is disposed inside the case to provide an elastic force in a direction of pushing the frame upward.

4. The vacuum cleaner according to claim 1, wherein when one side of the button is pressed, the frame moves upward, and when another side of the button is pressed, the frame moves downward.

5. The vacuum cleaner according to claim 1, wherein the frame includes a protruding portion configured to close the air hole.

6. The vacuum cleaner according to claim 1, wherein an interference rib protrudes from the button, and a sliding portion contacting the interference rib is provided in the case.

7. The vacuum cleaner according to claim 6, wherein when the button is pressed, the interference rib moves in one direction or in another direction along the sliding portion.

8. The vacuum cleaner according to claim 6, wherein the sliding portion comprises a first sliding portion extending in one direction and a second sliding portion bent downward from the first sliding portion.

9. The vacuum cleaner according to claim 8, further comprising an elastic member configured to provide an elastic force to the frame, and the elastic member provides the elastic force in a manner that the interference rib is fixed in a state of being positioned in the first sliding portion or the second sliding portion.

10. The vacuum cleaner according to claim 1, wherein a brush which is in contact with the surface to be cleaned is disposed on a bottom of the frame.

11. The vacuum cleaner according to claim 10, wherein a blade having the same height as the brush is disposed on the bottom of the frame.

12. The vacuum cleaner according to claim 11, wherein the brush and the blade are located along an outer circumference of the bottom of the frame.

13. The vacuum cleaner according to claim 11, wherein a hole into which the brush and the blade are inserted is formed in a bottom of the case.

14. The vacuum cleaner according to claim 1, wherein a bottom of the case includes a first surface that is in contact with the surface to be cleaned, and a second surface recessed upward from the first surface.

15. The vacuum cleaner according to claim 14, wherein the air hole is located at a side of the second surface.

16. A vacuum cleaner comprising:

a case including a suction port configured to suck foreign materials on a surface to be cleaned, and an air hole formed at one side of the case;

a frame accommodated in the case, and configured to open or close the air hole;

an interference rib configured to press the frame in one direction; and an elastic member configured to provide an elastic force to the frame in the opposite direction.

17. The vacuum cleaner according to claim 16, wherein the frame moves in the one direction to close the air hole, and moves in the opposite direction to open the air hole.

18. The vacuum cleaner according to claim 16, wherein a brush which is in contact with the surface to be cleaned is disposed on a bottom of the frame.

19. The vacuum cleaner according to claim 18, wherein when the frame moves in the one direction, the brush is accommodated in the case, and when the frame moves in the opposite direction, the brush protrudes from the case.

20. The vacuum cleaner according to claim 19, wherein a hole into which the brush is inserted is formed in a bottom of the case.

* * * * *